US006382123B1

(12) United States Patent
Grondin

(10) Patent No.: US 6,382,123 B1
(45) Date of Patent: May 7, 2002

(54) MULTICALIBER TORPEDO TUBE

(75) Inventor: Claude Grondin, La Farlede/Sollies-pont (FR)

(73) Assignee: Delegation Generale pour l'Armement, Arcueil (FR)

( * ) Notice: Subject to any disclaimer, the term of this patent is extended or adjusted under 35 U.S.C. 154(b) by 0 days.

(21) Appl. No.: 09/534,529

(22) Filed: Mar. 27, 2000

(30) Foreign Application Priority Data

Jun. 10, 1999 (FR) ..... 99 07697

(51) Int. Cl.[7] ..... F41F 3/10; B63G 8/32

(52) U.S. Cl. ..... 114/238; 114/239; 114/316; 114/318; 114/319

(58) Field of Search ..... 114/238, 239, 114/316, 317, 318, 319

(56) References Cited

U.S. PATENT DOCUMENTS

| | | | | | |
|---|---|---|---|---|---|
| 1,370,467 | A | * | 3/1921 | McMahon | 114/318 |
| 1,985,184 | A | * | 12/1934 | Methlin | 114/238 |
| 3,395,670 | A | | 8/1968 | Betzold | 114/238 |
| 5,174,236 | A | * | 12/1992 | Moody | 114/238 |
| 5,438,948 | A | | 8/1995 | Moody | 114/319 |
| 5,448,962 | A | * | 9/1995 | Moody | 114/238 |
| 5,645,006 | A | * | 7/1997 | Moody | 114/238 |

FOREIGN PATENT DOCUMENTS

| | | | | |
|---|---|---|---|---|
| DE | A1 24 55 994 | | 1/1979 | |
| FR | E 33.272 | | 4/1928 | |
| FR | 033272 E | * | 4/1928 | 114/238 |

* cited by examiner

*Primary Examiner*—Charles T. Jordan
*Assistant Examiner*—John W. Zerr
(74) *Attorney, Agent, or Firm*—Oliff & Berridge, PLC

(57) ABSTRACT

The invention relates in particular, to a torpedo tube having supporting devices able to support the torpedo and limit its friction when launched, such as slides. These supporting devices may be variable-geometry devices able to assume at least two positions, namely one through which there passes a circle whose diameter is equal to the maximum permissible diameter of the torpedo, and a second through which there passes a circle with a smaller diameter than the permissible diameter. These supporting devices may include inflatable bladders.

12 Claims, 2 Drawing Sheets

MULTICALIBER TORPEDO TUBE

BACKGROUND OF THE INVENTION

1. Field of Invention

The invention relates to the field of missile-launching ships, and in particular, to a torpedo tube.

2. Description of Related Art

On board a submarine or any other type of missile launcher, the torpedo tube is submerged and its operation requires that the pressure inside the tube be equalized with the environment, namely water, before being placed in communication therewith. It must thus, in particular, withstand water pressure which, in the case of submarines, may be approximately 100 bars. For this reason, the torpedo tube generally made of steel and its dimensions are permanently established when the craft is designed.

These torpedo tubes include slides, for example, an upper slide and two lower slides, arranged in an equilateral or isosceles triangle which are fixed and define a maximum circumference for the launcher. These slides limit friction between the device and the tube when the device is launched.

To increase the offensive and defensive capabilities of these craft, it has been proposed to launch various devices, possibly of different sizes, with a single tube.

However, while the slides are correctly positioned for properly launching a large-caliber device, this is not true for a lower-caliber device where the device can even rest directly on the tube if the diameter of the device is less than the space between the two lower slides.

SUMMARY OF THE INVENTION

The invention provides a multicaliber torpedo tube that is technically not complex, takes up little space, and requires little ancillary equipment.

The torpedo tube may include supporting devices able to support the torpedo and limit its friction when launched, such as slides. The supporting devices also may include variable-geometry devices able to assume at least two positions, namely one through which there passes a circle whose diameter is equal to the maximum permissible diameter of the torpedo and a second through which there passes a circle with a smaller diameter than the maximum permissible diameter. These variable-geometry devices may include inflatable bladders.

According to an additional aspect, the bladders may be connected to a single circuit, and this circuit can include a pipe having a connector connectable, for example, to a compressed-air system, an air compressor, a liquid system, or a pump.

According to another aspect, the bladders may be connected to a compressed-gas or liquid system, the latter possibly being water.

According to an additional aspect, the tube may include an upper slide having a groove.

According to a particular aspect, the groove may be in the shape of a cavity terminating in its lower part. The cavity may also be in the shape of a tee (T) or an omega (Ω).

A device according to the invention enables objects of various sizes to be launched, these objects possibly being torpedoes, decoys, manned devices, containers, etc., and also enables the number of tubes necessary for these launches to be decreased.

BRIEF DESCRIPTION OF THE DRAWINGS

Other advantages and characteristics will emerge from the description of particular embodiments of the invention with reference to the attached drawings.wherein.

DETAILED DESCRIPTION OF PREFERRED EMBODIMENTS

Figure 1:
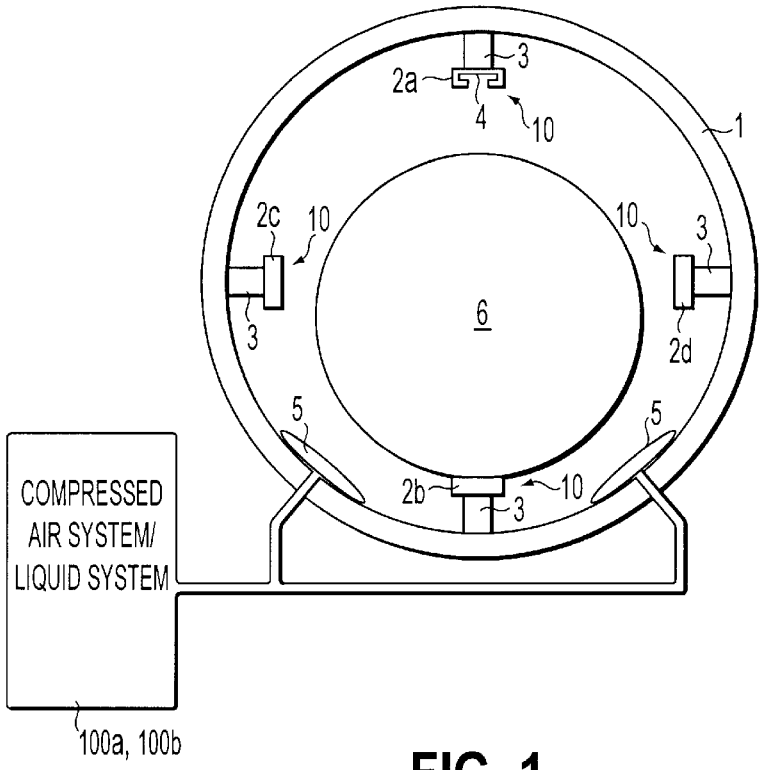
FIGS. 1 and 2 are diagrams of supporting devices able to support the torpedo and limit its friction when launched according to a first embodiment of the invention.
Figure 2:
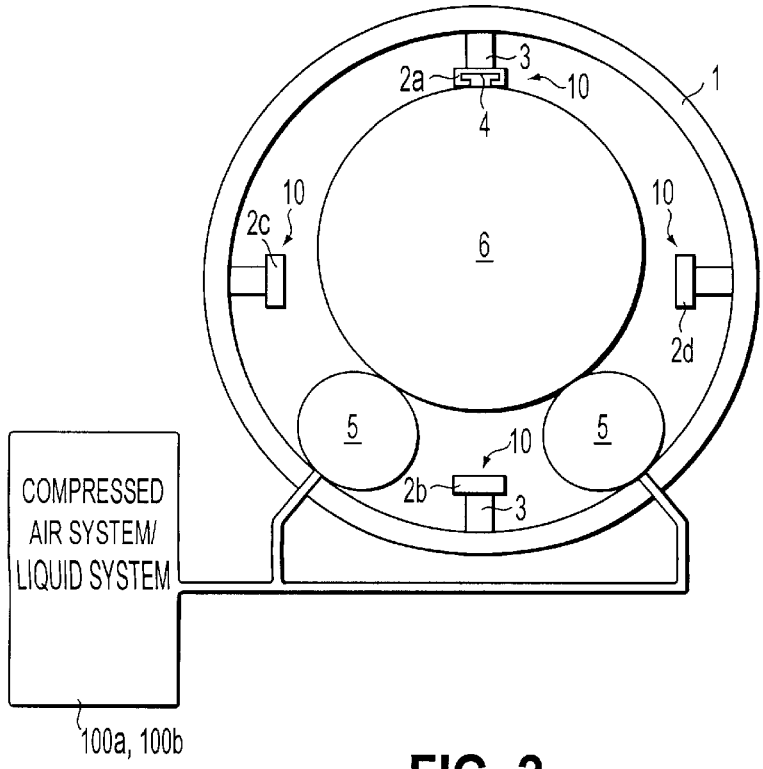

FIGS. 1 and 2 show supporting devices 10 that are able to support the torpedo 6 and limit its friction when launched, according to a first embodiment of the invention, in the retracted and in the active position, respectively.

These supporting devices 10 that are able to support the torpedo 6 and limit its friction when launched, include four longitudinal slides 2*a*–2*d* attached to a support 3 integral with the tube 1. Upper slide 2*a* has a groove 4 in the shape of an inverted U designed to cooperate with a longitudinal projection present on the periphery of the torpedo 6.

The supporting devices 10 also include inflatable bladders 5 distributed regularly along the tube 1 and on each side of the lower slide 2*b*, and connected in known fashion to the same circuit (not shown), including a pipe having a self-sealing connector and a bleed valve located near the rear of the tube 1.

When the rear airlock of the tube 1 is open, the self-sealing connector can be connected, in known fashion, to an enclosure having a deformable membrane separating the water from the compressed air, connected to a compressed-air system 100*a* (or liquid system 100*a*) having a valve, with the water being on the side of the connection between the enclosure and the self-sealing connector.

The device operates as follows.

With the airlock of the tube 1 open, the torpedo 6 is pushed inside the torpedo tube while it is resting on the lower slide 2*b*. The self-sealing connector is then connected to the enclosure and the valve is then open. The air in the enclosure is then pressurized. The pressure is then applied to the water which is sent to the bladders 5 causing the volumes of the bladders 5 to increase simultaneously, leading to vertical displacement of the torpedo 6 against the upper slide 2*a*. Bladders 5 are then in the active position. The self-sealing connector is then disconnected from the enclosure and the airlock is closed.

It is possible for the airlock to be open and the connector connected to the enclosure before an object is launched in order slightly to decrease the pressure applied by bladders 5 to the torpedo 6 by activating, for example, a calibrated valve located on the compressed-air side of the enclosure. The airlock is then closed and torpedo 6 can then be launched.

Such a supporting device 10 has the advantage of adapting to any size of torpedo 6 or object to be launched.

Figure 4:
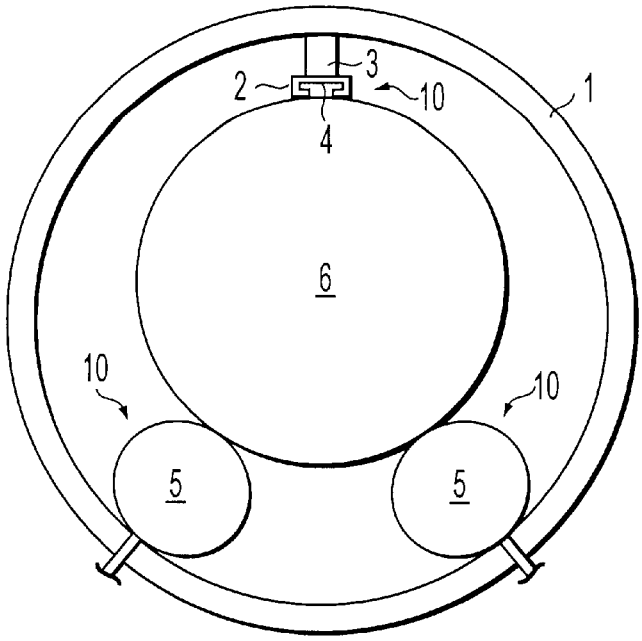
FIGS. 3 and 4 are diagrams of supporting devices able, in particular, to support the torpedo when stored, according to a second embodiment of the invention.
Figure 3:
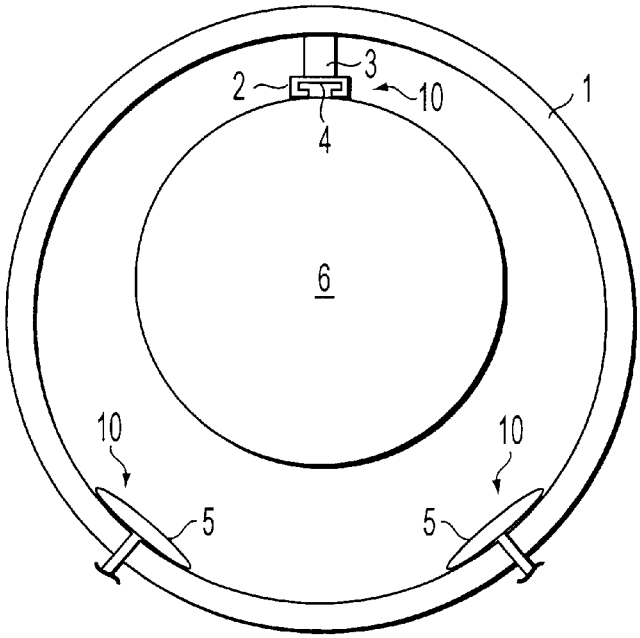

FIGS. 3 and 4 show supporting devices 10 that are able to support the torpedo 6, mainly while it is in storage according to a second embodiment of the invention, in the retracted position and the active position, respectively.

These supporting devices 10, which are able to support the torpedo and limit its friction when launched, include an upper longitudinal slide 2*a* attached to a support 3 integral with the tube 1. This upper slide 2*a* has a T-shaped groove 4 designed to cooperate with a longitudinal T-shaped projection present on the periphery of the torpedo 6 in order to form a slide.

They also have inflatable bladders 5 that are regularly distributed along the tube 1, in its lower part on either side of its vertical plane of symmetry, and are connected in known fashion to the same circuit (not shown), having a pipe on which a self-sealing connector, a calibrated valve, and a vent valve, are disposed.

When the tube airlock is open, the self-sealing connector can be connected in known fashion to a compressed-air system 100*a* having a manual valve.

This device operates as follows.

With the tube airlock open, the torpedo 6 is pushed inside the torpedo tube 1 and is suspended from upper slide 2*a* by its longitudinal T-shaped projection.

The self-sealing connector is then connected to the compressed-air system and the manual valve is open. The compressed air then causes the volumes of all the bladders 5 to increase simultaneously, the bladders 5 then being in the active position holding torpedo 6 in its position, thus limiting the forces applied by the torpedo 6 to the upper slide 2*a*. The connector is then disconnected from the compressed-air system 100*a* and the airlock is closed.

Before the torpedo 6 is launched, the airlock is opened and the vent valve is opened to deflate the bladders, then the airlock is closed.

Such a device has the advantage of adapting to any torpedo size. Numerous modifications may be made to the embodiments described without departing from the framework of the invention.

What is claimed is:

1. A torpedo tube, comprising:

a plurality of supporting devices that support the torpedo and limit its friction when launched, the plurality of supporting devices including at least one slide and at least one variable-geometry device, wherein the at least one variable-geometry device has inflatable bladders distributed on each side of the at least one slide.

2. The torpedo tube of claim 1, wherein the inflatable bladders are distributed along the torpedo tube.

3. The torpedo tube of claim 1, wherein the inflatable bladders are regularly distributed along the torpedo tube.

4. The torpedo tube of claim 1, wherein the inflatable bladders are connected to a compressed-air system.

5. The torpedo tube of claim 3, wherein the inflatable bladders are connected to an air compressor.

6. The torpedo tube of claim 1, wherein the inflatable bladders are connected to a liquid system.

7. The torpedo tube claim 6, wherein the liquid is water.

8. The torpedo tube of claim 1, wherein the inflatable bladders are connected to a same circuit.

9. The torpedo tube of claim 8, wherein the circuit includes a pipe having a connector.

10. The torpedo tube of claim 1, wherein one of the supporting devices includes an upper slide having a groove.

11. The torpedo tube according to claim 10, wherein the groove is in the shape of a cavity terminating in its lower part.

12. The torpedo tube of claim 11, wherein the cavity is in the shape of a tee (T).

* * * * *